US005832965A

United States Patent [19]

Fasse et al.

[11] Patent Number: 5,832,965

[45] Date of Patent: Nov. 10, 1998

[54] AEROSOL CONTAINER FILLING APPARATUS

[76] Inventors: James H. Fasse, 741 River Oaks Dr.; Ralph R. Worm, 550 Giddings Ave., both of Sheboygan Falls, Wis. 53085

[21] Appl. No.: 778,088

[22] Filed: Jan. 2, 1997

[51] Int. Cl.[6] ..... B65B 3/04

[52] U.S. Cl. ..... 141/20; 141/372

[58] Field of Search ..... 141/3, 20, 372

[56] References Cited

U.S. PATENT DOCUMENTS

| | | | |
|---|---|---|---|
| 3,013,591 | 12/1961 | Stanley et al. | 141/3 |
| 3,234,707 | 2/1966 | Weston | 141/20 |
| 3,592,244 | 7/1971 | Chamberlin | 141/20 |
| 3,718,165 | 2/1973 | Grothoff | 141/20 |
| 4,938,260 | 7/1990 | Hirz | 141/20 |
| 4,999,976 | 3/1991 | Smith | 141/20 |
| 5,345,980 | 9/1994 | Burt et al. | 141/3 |
| 5,535,790 | 7/1996 | Hirz | 141/20 |
| 5,647,408 | 7/1997 | Erste et al. | 141/20 |

*Primary Examiner*—J. Casimer Jacyna
*Attorney, Agent, or Firm*—R. Jonathan Peters

[57] ABSTRACT

In accordance with the present invention, the filling apparatus for charging a pressurized aerosol container with a liquid product utilizes a male injector depending from a liquid reservoir in conjunction with a female valve of the container. The aerosol can is positioned or adjusted between a can non-filing position and a filling position, and pressure selectively draws liquid from the reservoir to the can when in a filling position. A substantially cylindrical housing engageable with and extending from the reservoir has an axial bore for liquid communication with the reservoir. A valve control having a valve body disposed in the axial bore of the cylindrical housing and having a central opening in liquid communication with the axial bore, includes a hollow injector pin extending longitudinally from the valve body and concentrically arranged with the opening of the valve body and terminates with at least one aperture. The valve control is biased to a closed, no-filling position, and when the can is in a filling position the injector pin is adapted to be received by the female valve, thereby establishing liquid communication between the reservoir and the can. A locking nut retains the valve control in the axial bore of the cylindrical housing. When the can is in a filling position, liquid flows from the reservoir and through the axial bore of the cylindrical housing, the valve control, the female valve, the dip tube depending downwardly from the female valve, and into the can.

13 Claims, 4 Drawing Sheets

AEROSOL CONTAINER FILLING APPARATUS

FIELD OF THE DISCLOSURE

This invention relates to an apparatus for filling an aerosol container. In its more specific aspect, this invention relates to an apparatus or device for filling an aerosol container having a female valve with liquid product.

BACKGROUND AND PRIOR ART

Aerosol dispensers, which are well known and used in abundance, consist of a self-pressurized and hermetically sealed container of metal, glass, or plastic. Most typically, the dispenser is charged or filled with the aerosol product, e.g., paint, lacquer, enamel, acrylic, fragrance, cleaning agent, etc., and then charged with a propellant and sometimes a solvent; but for a small percentage of dispensers, the container is preloaded with a propellant and sometimes a solvent, and then charged with the aerosol product. The product is dispensed, upon actuating a metering device or actuator, as a spray, foam, lotion, or the like.

Filling the precharged dispenser or container with the aerosol product may be accomplished with an automatic system used in high volume applications, which meters a preselected amount of product into the container, or with a manual system. Regardless which system is used, usually depending upon volume, the apparatus typically includes a can holding means spaced below a reservoir for holding the liquid product. The male valve which is mounted in the cup of the container is brought into engagement with the reservoir outlet, and liquid flows from the reservoir through the valve and a downwardly depending dip tube, and then into the container. In the filling operation, it is important that the amount of liquid for each container must be accurate, that the operation be clean with essentially little or no leakage or overflow, and there be essentially little or no clogging.

An automatic pneumatic filling system for charging an aerosol can is described in U.S. Pat. No. 4,938,260. This known filling system utilizes a can receiver having a female liquid outlet depending downwardly from the reservoir, and the male valve seat or stem of the can is brought into engagement with the outlet for the can receiver. The filling apparatus includes a platform having a movable support means for supporting the aerosol can, and a liquid reservoir spaced above the platform. A reciprocating piston or plunger is disposed above and coaxial with the female liquid outlet, and each downward stroke or extended position of the piston or plunger applies pressure against the liquid in the outlet, thereby forcing the liquid into the can. A check ball is positioned in the reservoir and over the opening to the outlet in order to prevent the flow of liquid from the reservoir when the piston is in a retracted position. Thus, in operation, a can positioned on the support means is automatically raised so that the male valve stem of the can engages the female outlet of the reservoir. As a consequence, the male valve stem, which is normally spring biased to a closed position, unseats the check ball over the outlet in the reservoir. The pressure applied against the liquid by the reciprocating piston opens the male valve and permits the liquid to flow from the reservoir and into the can. A pneumatic pump means forces a measured amount of liquid into the can. When filled, the can is automatically lowered, an actuator is placed over the male valve, a cover placed over the top, and the can is now ready for use by the consumer.

Although in wide use, this type of system has several disadvantages. The connection between the female reservoir outlet and the male valve stem does not provide a tight liquid seal between the two members. Further, the check ball in the reservoir is gravity dependent, and when a filling operation is finished, there is frequently a time lag before the ball finds its seat, particularly with viscous liquids. Thus, overspill and leakage are somewhat common, which results in an unnecessary loss of liquid product, a messy cup, lost time in cleaning the can cup, and a dirty work area. Also, clogging should be avoided, but is a known problem with this system.

This invention has therefore as its purpose to provide an improved apparatus or device for filling an aerosol container, which improvement may be utilized with either an automatic or manual system.

SUMMARY OF THE INVENTION

In accordance with the present invention, the filling apparatus for charging a pressurized aerosol container utilizes a male injector fling device depending from the liquid reservoir in conjunction with a female valve of the container. It should be understood that the terms "dispenser," "container" and "can" are used herein interchangeably and synonymously. Known filling systems used in the industry comprise a support means for the aerosol can, including means for selectively positioning, or raising and lowering, the support means between a can non-filling position and a filling position; a liquid reservoir spaced above the support means; and means for selectively drawing liquid from the reservoir into the can when in a filling position. In accordance with our invention, the improvement utilizes a filling apparatus or filling injector comprising a substantially cylindrical housing, which is engageable with and extends from the reservoir, and has an open-ended, axial bore for liquid communication with the reservoir. Valve control means includes a valve body disposed in the axial bore of the cylindrical housing, and the valve body has a central opening in liquid communication with the axial bore. A hollow injector pin extends longitudinally from the valve body and is concentrically arranged with the opening of the valve body, and the injector pin terminates with at least one aperture. Suitable means, such as a locking nut, retains the valve control means in the axial bore of the cylindrical body. The valve control means is biased to a closed, no-filling position, and establishes liquid communication between the reservoir and the can when the can is in a filing position. The injector pin is adapted to be received by the female valve when the can is in a filling position. Thus, when the can is brought to a filling position, the valve control means is opened so that liquid will flow from the reservoir and through the axial bore of the cylindrical body, the valve control means, the female valve of the can, the dip tube depending downwardly from the female valve, and into the can.

In a preferred embodiment of the invention, means to bias the valve control means to a closed position comprises a helically wound spring seated longitudinally in the central opening of the valve body with the lowermost coil of the spring positioned adjacent the injector pin. A ball check valve is seated on or atop the spring, and an annular retainer is seated on the valve body and above the check valve. Further, the annular retainer is provided with a central aperture concentric with the opening of the valve body, and the ball check valve is biased against this central aperture by the spring to close the central aperture when the can is in a no-filling position. Hence, no liquid will flow from the reservoir. We have found it also desirable to provide a can centering guide or locator having a longitudinal opening, which is concentrically arranged with and slidably mounted on the cylindrical housing. The opening tapers inwardly and upwardly of sufficient diameter so as to accept the perimeter of the top rim of the can cup. Suitable means, such as a coiled spring disposed on the shank of the cylindrical housing, will bias the can locator toward a neutral or closed, no-filling position, but when the can is brought to a filling position, the taper in the opening of the locator guides or directs the can toward the injector pin, thereby bringing the female valve into registry with the male injector. It is preferable that the injector pin terminates with a truncated conical section having two oppositely disposed apertures in the conical section. Pressure applied against the liquid in the reservoir forces the valve control means to an open position thereby permitting the flow of liquid into the can.

DETAILED DESCRIPTION OF THE INVENTION

Figure 1:
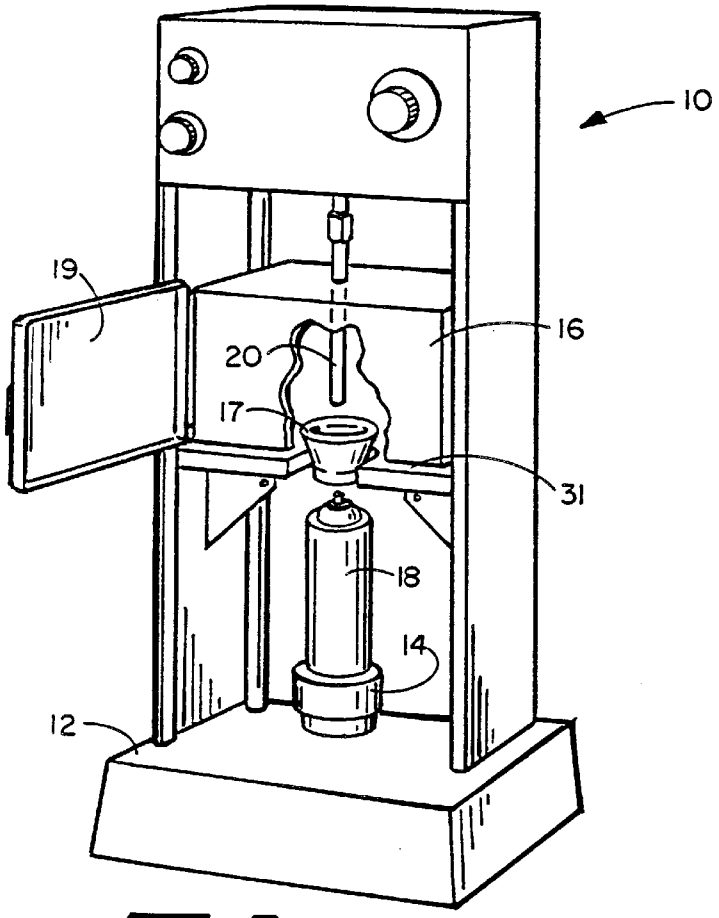
FIG 1 PRIOR ART
FIG. 1 is a front elevational, partly fragmentary, view of an automatic, pneumatic filling system and embodying the features of the present invention.

Referring to the drawings wherein the same reference numerals refer to similar parts throughout the various views, there is shown in FIG. 1 an aerosol can filling system, indicated generally by the numeral 10. A system of this general type is well known in the art, such as disclosed in U.S. Pat. No. 4,938,260 which is incorporated herein by reference. However, as explained above, a system of the specific type disclosed in the '260 patent utilizes, in particular, a can receiver having a female liquid outlet extending from the liquid reservoir for filling a container having a male valve. Also, as explained above, a system utilizing this feature has numerous disadvantages, which are overcome by the improvement of the present invention.

Briefly, the can filling system of the type depicted in FIG. 1, and of the type described in the '260 patent, comprises a base or platform 12 having a can supporting means 14. A liquid reservoir 16, for holding a suitable quantity of liquid product, e.g. paint, and typically about one gallon, is positioned above the platform, and a can receiver with a female liquid outlet 17 depends downwardly from the reservoir. A hinged door 19 protects the reservoir zone and the operator. A suitable pump and lift control assembly (not shown) for automatically lifting and filling the can 18 by pneumatic means, and powered by compressed air from a suitable air supply, is described fully in the '260 patent. The can supporting means is raised and lowered by the pneumatic cylinder/piston assembly (not shown) which is actuated by a pneumatic signal from a switch. When the can 18 is in a filling position, a second cylinder/piston assembly 20 forces liquid from the reservoir into the can, as explained below in greater detail. The piston reciprocates between a fully extended position and fully retracted position, and the number of strokes by the piston is set by an automatic counter which has been predetermined in order to fill the can with the correct amount of liquid.

Figure 2:
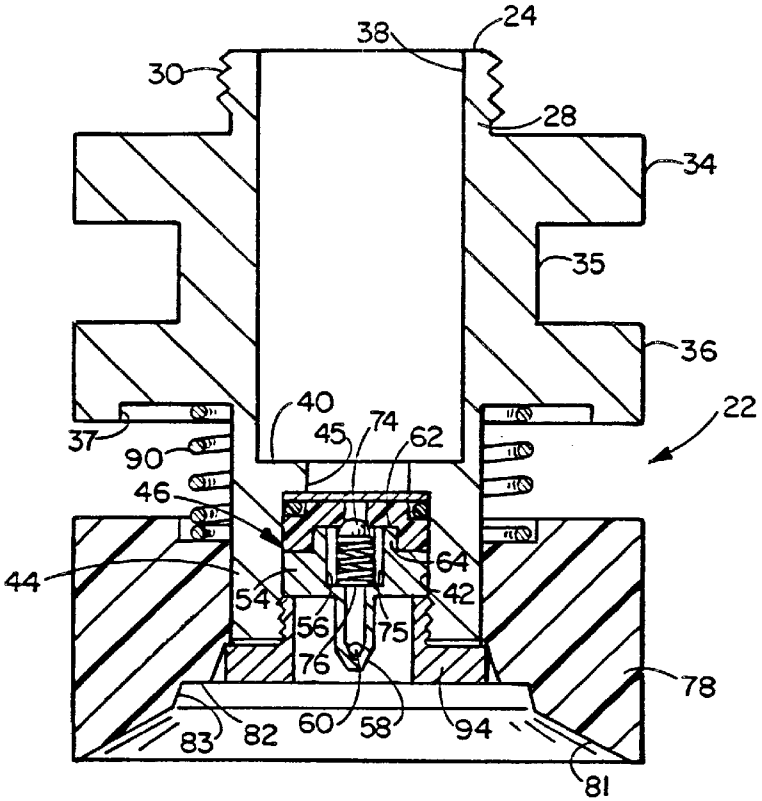
FIG. 2 is an enlarged, cross-sectional view of the injector filling device utilized in the system of the type shown in FIG. 1.
Figure 3:
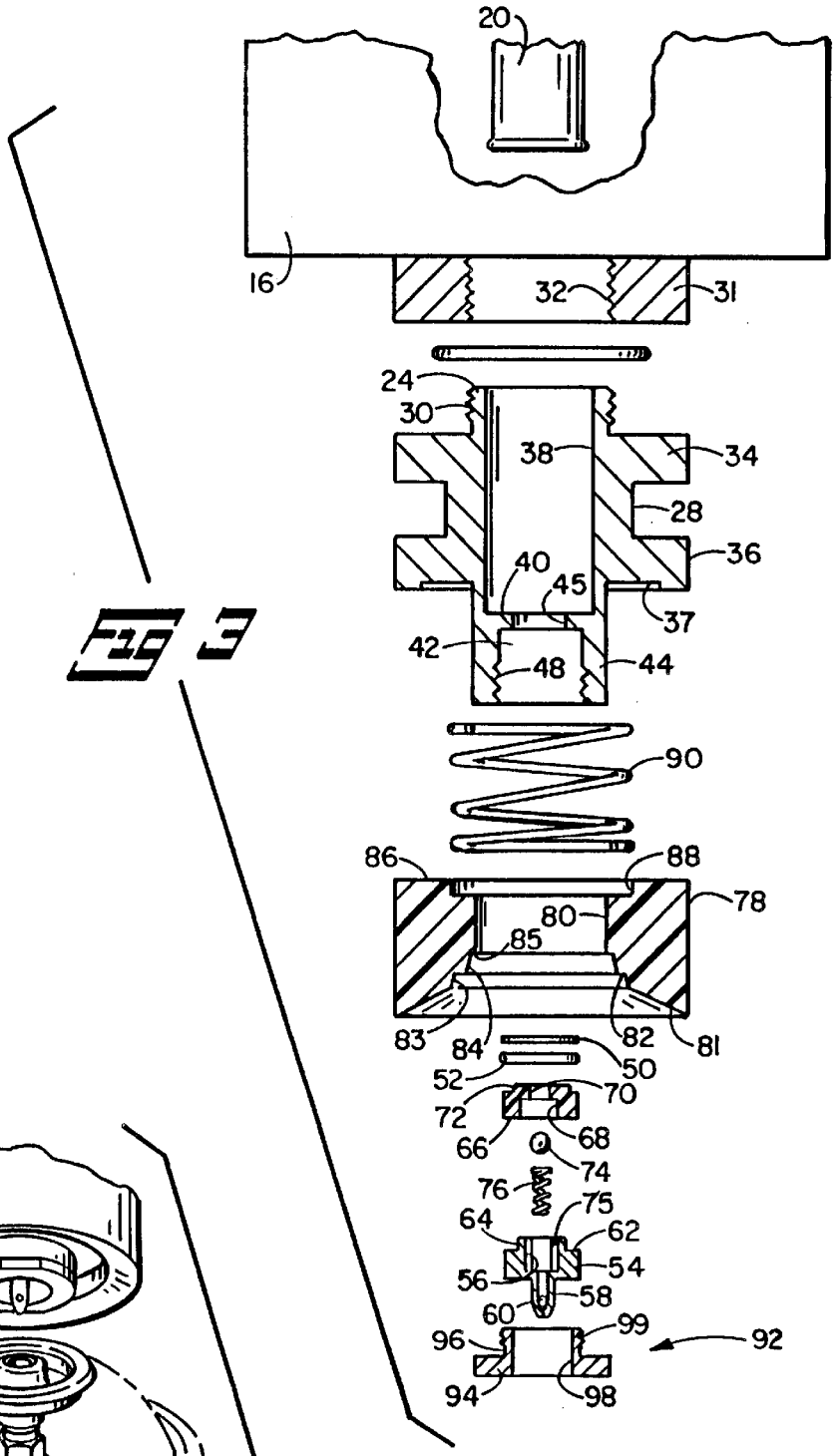
FIG. 3 is an exploded, longitudinal view, partly in cross-section, of the device of FIG. 2.
Figure 4:
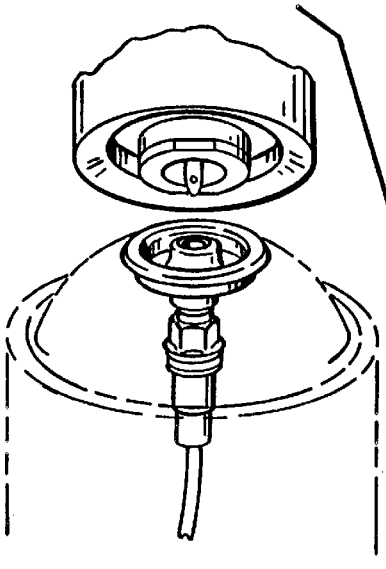
FIG. 4 is a perspective view showing the relative positioning of the device of FIG. 2 with the female valve of the can as the can is being raised to a filling position.

Referring now to FIGS. 2, 3 and 4, which show in greater detail the filling apparatus embodying the present invention, the male injector filling device, indicated generally at 22, includes a cylindrical housing 24 having an open-ended axial bore 26 extending the length (longitudinally) of the housing. The outside diameter of the housing 24 need not be uniform throughout its longitudinal length, and the upper end section or shank 28 of the housing is externally threaded at 30. The bottom of the reservoir 16 has a central opening 32, (see FIG. 3), which is internally threaded, and threaded section 30 of the housing 24 threadedly engages the threaded opening 32 of the reservoir. Spaced annular flanges or collars 34 and 36 extend laterally from the housing and are formed integrally therewith, and upper annular collar 34 is positioned about adjacent the externally threaded section 30 of shank section 28. The shank portion 35 between the annular collars is provided with oppositely disposed planar surfaces 33, and the assembly of the housing and reservoir is slid into a slot of mid-support plate 31 along the planar surfaces, and the assembly is then turned a one-quarter revolution to lock and suspend the assembly in place. Also, the horizontal, planar surface of the annular collar 36 facing dowwardly toward the can is recessed at 37 for the purpose described below.

The axial bore 26 has an enlarged cylindrical section 38 of a first diameter terminating inwardly at annular shoulder 40, and a coaxial second cylindrical section 42 of a smaller diameter, thereby defining downwardly extending shank portion 44 of the housing 24. Annular shoulder 40 has a central opening 45, which is of smaller diameter than the diameter of cylindrical section 42, and thereby establishes fluid communication between cylindrical sections 38 and 42. It will be observed that when the threaded section 30 of cylindrical housing 24 is engaged with the threaded opening 32 of the reservoir 16, the housing thereby being supported by and extending downwardly from the reservoir, the longitudinal axis of the bore 26 is substantially coaxial with the longitudinal axis of the opening 32. Further, the first annular collar 34, positioned below the external threaded section 30, about abuts the bottom of the reservoir. Thus, liquid communication is established between the reservoir 16 and the axial bore 26 of the housing 24.

The smaller diameter cylindrical section 42 of bore 26 accommodates the valve control means, indicated generally at 46, described herein below in greater detail. Further, the distal end of this section 42 of the housing 24 with reference to its engagement with the reservoir is internally threaded at 48 outwardly from internal shoulder 40. A suitable screen 50 or other filter means is disposed in section 42 and adjacent opening 45 for filtering out foreign matter, and can be held in place by a gasket 52 such as a TEFLON O-ring or the like.

The valve control means 46 arranged in the axial bore 26 of the housing 24 controls liquid communication and flow between the liquid reservoir 16 and the can 18. As more clearly shown in FIG. 3, valve control means comprises annular valve body 54 disposed in cylindrical section 42 (the lower section of bore 26 and having the smaller diameter relative to cylindrical section 38), and has a central opening or aperture 56 in liquid communication with the bore. It thus will be observed that the opening 56 is of smaller diameter than the diameter of cylindrical section 42. A hollow injector pin 58 extends longitudinally from the valve body 54, and is concentrically arranged with the opening 56 so that the longitudinal bore of the hollow pin is coaxial with the opening 56. In a preferred embodiment, the injector pin 58 terminates with a truncated cone, and oppositely disposed apertures 60 are provided in the conical section just above the truncated end.

The valve body 54 terminates with an inwardly extending shoulder 62 and upwardly extending neck 64 which is of smaller diameter than the valve body. A retainer ring 66, preferably of plastic such as DELRON which is dense and resistant to chemical attack, has a centrally disposed recess 68 for accommodating neck 64 and for seating on shoulder 62. Further, the retainer ring has a central aperture 70, which is coaxial with recess 68. Retainer ring 66 has a central neck 72 for seating in O-ring 52.

Valve control means 46 further includes ball check valve 74 maintained in a closed position by suitable bias means 76 such as a coiled spring. Thus, coiled spring 76 is disposed in the central opening 56 of the valve body 54 and seats at its lower end adjacent the hollow pin. Ball check valve 74 seats on the upper end of the coiled spring, which biases the ball against a cooperating seat defined by aperture 70 of the retainer ring 66. In this position, the valve control means is closed so as to prevent the flow or passage of liquid from the reservoir. Also, we have found it preferable that the coils at the upper end of the spring be substantially closed, thereby creating a more uniform presentation to the seat for the ball. Upon actuating the cylinder/piston assembly 20, the pressure applied against the liquid in the reservoir unseats the ball 74 from its cooperating seat defined by aperture 70, thereby opening the valve control means and allowing for the flow of liquid, as explained below in more detail.

The spring 76 can become clogged with liquid passing through the opening 56 and the spring. In order to avoid clogging, it is preferable to provide one or more longitudinal channels 75 paralleling opening 56 and extending from the neck 64 to the pin 58. Preferably, the valve body has two oppositely disposed, parallel channels. The channels open to the central opening 56, and are free of obstructions. Thus, the liquid will flow through the channels rather than the spring, thereby enhancing the flow of liquid.

In order to guide the can to the injector when raised to a filling position, we have provided a can centering guide or locator 78. The locator, which is formed or molded of plastic that is durable, such as DELRON, having an annular or ring configuration, has a central opening 80 for slidable movement on shank section 44 of the cylindrical housing 24. The undersurface or bottom of the locator 76 has an inwardly and upwardly tapered wall section 81, which functions as a preliminary guide as the can is brought to the filling position, and a lateral or inwardly extending land or annular shoulder 82 which serves as a seat for the top rim of the can mounting (described below in detail). Where desired, the locator is provided with a second inwardly and upwardly tapered wall section 83 having a greater angle than tapered wall 81 with respect to the longitudinal axis of the opening 80, and a third inwardly and upwardly tapered wall section 84 terminating at lateral, annular shoulder 85. The opening 80 extends from annular shoulder 85 and terminates at the top surface 86 of the locator. Also, the top surface 86 is provided with an annular recess 88 circumscribing the opening 80.

As stated above, the locator 76 is mounted on the shank section 44 of the housing 24, and is free for reciprocal slidable movement. Suitable bias means 90 such as a coiled spring surrounding the shank 44 is positioned between the annular flange 36 and the locator 76. In a preferred embodiment of the invention, the coiled spring 90 seats at one end in annular recess 37 and at the other end in annular recess 88, thereby helping to retain the spring in its proper position. The normal bias of the spring 90 is predetermined to hold the can locator in a neutral or non-filling position, as shown in FIG. 5A.

In the illustrative embodiment, and as explained above, the lower end of shank section 44 of the housing 24 is internally threaded at 48. A retaining means comprises a locking nut 92, having a head 94 and shank 96, and has a central open-ended bore 98 extending longitudinally through the shank and head which is concentric with and coaxial with bore 26. Further, the shank 96 is externally threaded at 99 so as to threadedly engage with the internally threaded section 48 of shank section 44. Thus, when the locking nut 92 is engaged, valve control means is retained in the axial bore 26. The head 94 is of sufficient diameter so as to be circumscribed by the annular shoulder 85 of locator 78 when the locator is in a neutral or non-filling position. In this manner, the head 94 abuts or seats against the shoulder 85 of the locator 78 when biased by the spring 90 to a neutral or non-filling position. (See FIG. 5A.) Also, when in a neutral position, the outer surface of the head 94 is substantially coplanar with the land 82.

Figure 5A:
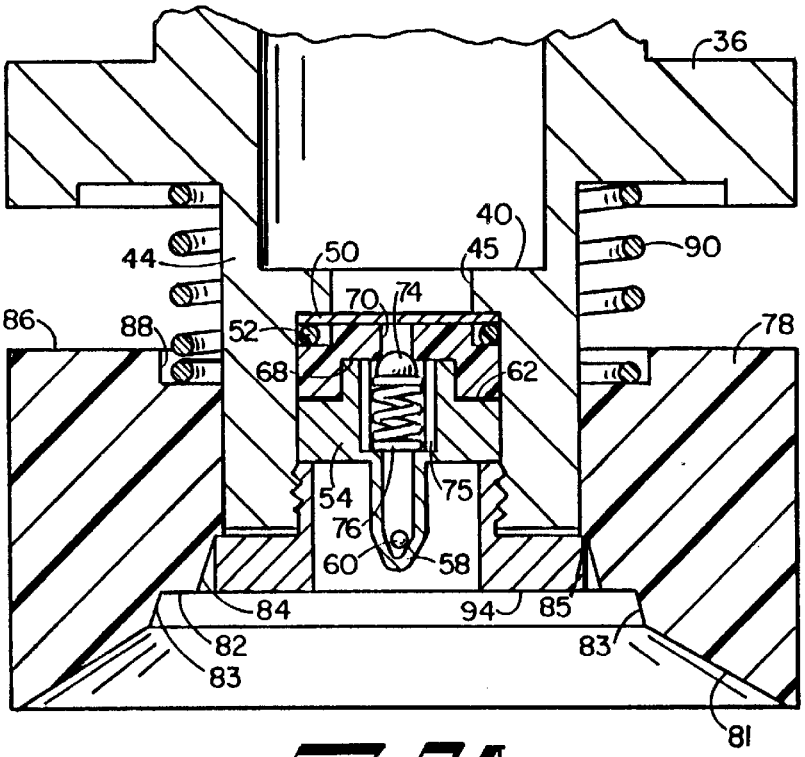
FIG. 5A illustrates in greater detail the device of FIG. 2 showing the valve control means and can centering guide in a non-filling position.
Figure 5B:
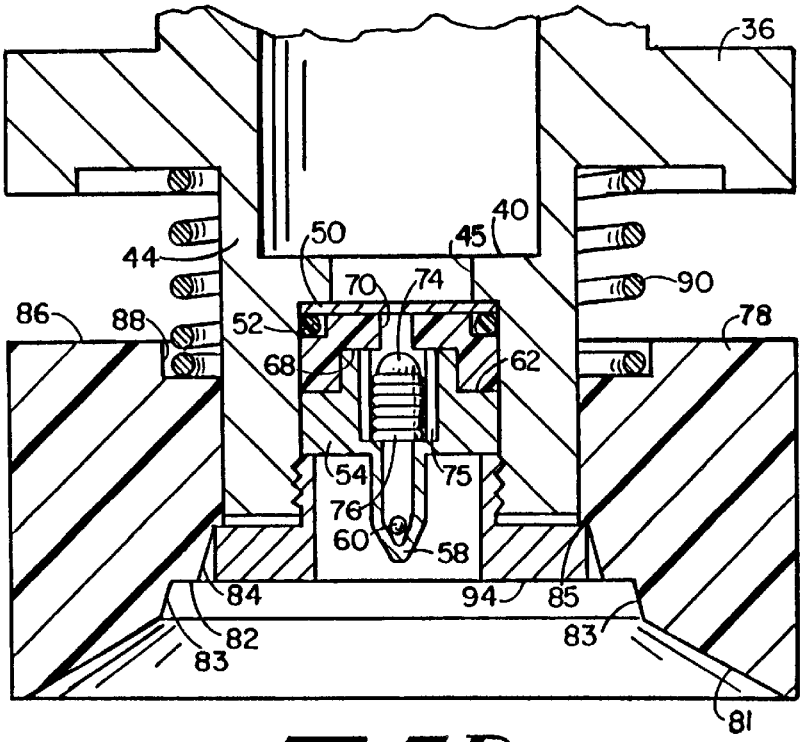
FIG. 5B illustrates the valve control means and can centering means of FIG. 5A in a filling position.

For a filling operation, a can 18 of desired size (e.g., 6 fluid ounce can, 12 fluid ounce can, or 16 fluid ounce can) is placed on can supporting means 14, and the injector 22 is biased to a closed position as shown in FIG. 5A. Thus, ball check valve 74 is biased against aperture 70, and liquid will not pass or flow from the reservoir 16. The can supporting means is then actuated to raise the can to a filling position. FIG. 4 shows the relative positioning between the male injector 22 and the female valve 100 of the can. The top of a conventional can has a mounting cup 102 with a circumferential top rim 104 crimped to the can bead, and the female valve, disposed in the throat 105, is centrally mounted on the cup. As the can is raised to a filling position, the can is guided toward the male injector 22 by the tapered walls 81 and 83 of the locator 78. The top rim 104 seats on the land 82 of the can locator 78, and the head 94 of locking nut 93 is centered in the cup 102 and circumscribed by the top rim, and thereby pushes the locator upward against the bias of spring 90. (See FIG. 5B.) The diameter of head 94 is predetermined to about coincide with the inside diameter of the top rim 104 so as to provide sturdy contact and prevent any wobbling. Simultaneously, the cylinder/piston assembly 20 is actuated, and pressure against the liquid in the reservoir 16 forces the valve control means 46 open by pushing the ball 74 downwardly against the bias of spring 76. Preferably, the injector pin 58 extends outwardly from the end wall of the cylindrical housing 24 so that the injector pin protrudes a sufficient distance into the throat of the female valve 100 in order to open valve typically closed by a suitable check valve (not shown). Liquid then flows from the reservoir 16, through the axial bore 26 of the housing 24, through the valve control means 46, through the female valve 100, and down through the dip tube 106 and into the can 18. When the can is filled with the required amount, the valve control means is actuated to a closed position, the can is lowered and then removed from the platform. A conventional actuator (not shown) is placed over the female valve, and a protective cover is inserted on the top of the can. The aerosol can is now ready for use by the consumer.

Figure 6A:
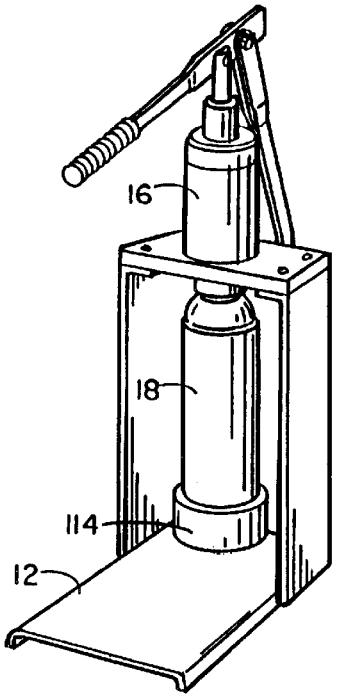
FIG. 6A is a perspective view of a manual filling system embodying the features of the present invention.
Figure 6B:
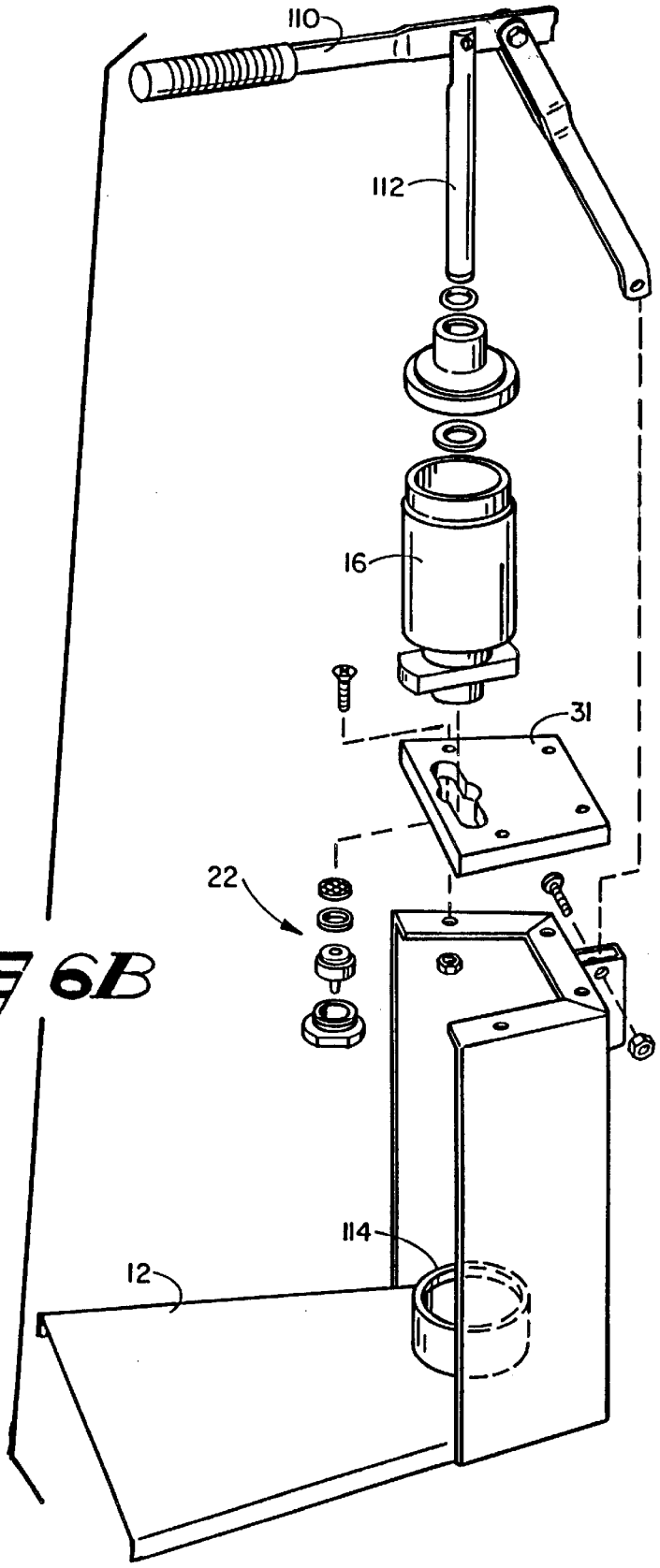
FIG. 6B is an exploded view of the system of FIG. 6A.

A manual filling system differs mainly from an automatic system in that the manual system is hand actuated. As shown in FIGS. 6A and 6B, handle 110, which is hand actuated by the operator, reciprocates plunger 112 between a fully extended position and fully retracted position. A can riser 114 is positioned on the platform 12, the size or height of the riser depending upon the size of the can. When actuated, the plunger applies pressure on the fluid in the reservoir 16. This actuation in turn opens valve control means 46, thereby permitting the flow of fluid into the can, substantially as described above. When the can is filled with the proper quantity of liquid, the plunger is retracted, the can removed, and then equiped with an actuator for use by the consumer, as described above.

It will be observed that the invention provides for several advantages. The male injector adapter produces a tight liquid seal between the can and reservoir, which results in substantially no liquid on the mount at the top of the can as compared to known systems using a different valve arrangement. The can centering guide enhances the positioning or registry of the injector with the female can valve. Also, the injector has a built-in check-valve assembly to prevent the liquid and propellant from escaping from the can as the injector opens the can valve. Further, it should be understood that the foregoing detailed description has been given for clearness of understanding only, and no unnecessary limitations should be understood therefrom, as modifications will be obvious to those skilled in the art.

What is claimed is:

1. In an apparatus for charging a pressurized aerosol can with a liquid product, the aerosol can having a female valve and a dip tube depending downwardly from the female valve and into the can, which comprises a support means for positioning the aerosol can for a filling position, a liquid reservoir spaced above the support means, and means for selectively drawing liquid product from the reservoir to the can when in a filling position; the improvement comprising: (a) a substantially cylindrical housing engageable with and extending from the reservoir and having an axial bore for liquid communication with the reservoir; (b) valve control means normally biased to a closed position and establishing liquid communication between the reservoir and the can when in a filling position, said valve control means having (i) a valve body disposed in said axial bore of said cylindrical housing and having a central opening in liquid communication with said axial bore, and (ii) a hollow injector pin extending longitudinally from said valve body and concentrically arranged with said central opening and terminating with at least one aperture, said injector pin adapted to be received by the female valve when the can is in a filling position; and (c) means to retain said valve control means in said axial bore of said cylindrical housing; whereby when the can is in a filling position, liquid flows from the reservoir and through said axial bore of said cylindrical housing, said valve control means, the female valve, the dip tube, and into the can.

2. An apparatus according to claim 1 wherein said injector pin terminates with a truncated conical section having two oppositely disposed apertures in said conical section.

3. An apparatus according to claim 1 or claim 2 wherein said truncated conical section extends outwardly from the end wall of said cylindrical body.

4. An apparatus according to claim 1 or claim 2 wherein said axial bore of said cylindrical housing has a threaded section at the distal end of engagement with said reservoir, and said retaining means comprises a locking nut of sufficient diameter for retaining said valve control means, and having a threaded shank for threadedly engaging said threaded section of said axial bore.

5. An apparatus according to claim 1 or claim 2 further including a can centering guide having a longitudinal opening and concentrically arranged with and slidably mounted on said cylindrical housing to reciprocate between a no-filling position and a filling position, said longitudinal opening having an outwardly tapered wall to form an opening of larger diameter than said longitudinal opening and being sufficient to accept the can and guide the female valve to said injector when the can is brought to a filling position.

6. An apparatus according to claim 1 or claim 2 further including means to bias said valve control means to a closed position which comprises a helically wound spring having a plurality of coils and seated longitudinally in said central opening of said valve body with the lowermost coil of said spring positioned adjacent said injector pin, a check valve seated on said spring, and an annular retainer seated on said valve body and above said check valve, said annular retainer having a central aperture concentric with said opening of said valve body, and said check valve biased against said central aperture by said spring to close said central aperture when the can is in a non-filing position.

7. An apparatus according to claim 6 wherein the uppermost coils of said spring being closed.

8. An apparatus according to claim 1 or claim 2 wherein said valve body has at least one longitudinal channel.

9. In an apparatus for charging a pressurized aerosol can with a liquid product, the aerosol can having a female valve and a dip tube depending downwardly from the female valve and into the can, which comprises a support means for positioning the aerosol can for a filling position, a liquid reservoir spaced above the support means, and means for selectively drawing liquid product from the reservoir to the can when in a filling position; the improvement comprising: (a) a substantially cylindrical housing engagable with and extending from the reservoir and having an axial bore for liquid communication with the reservoir; (b) valve control means normally biased to a closed position and establishing liquid communication between the reservoir and the can when in a filling position, said valve control means having (i) a valve body disposed in said axial bore of said cylindrical housing and having a central opening in liquid communication with said axial bore, said valve body having a pair of opposed longitudinal channels which open to said central opening, and (ii) a hollow injector pin extending longitudinally from said valve body and concentrically arranged with said central opening and terminating with a truncated conical section having two oppositely disposed apertures in said conical section, said injector pin adapted to be received by the female valve when the can is in a filling position; (c) a can centering guide having a longitudinal opening and concentrically arranged with and slidably mounted on said cylindrical housing to reciprocate between a no-filling position and a filling position, said longitudinal opening having an outwardly tapered wall to form an opening of larger diameter than said longitudinal opening and being sufficient to accept the can and guide the female valve to said injector when the can is brought to a filling position; and (d) means to retain said valve control means in said axial bore of said cylindrical housing; whereby when the can is in a filling position, liquid flows from the reservoir and through said axial bore of said cylindrical housing, said valve control means, the female valve, the dip tube, and into the can.

10. An apparatus according to claim 9 wherein said truncated conical section extends outwardly from the end wall of said cylindrical body.

11. An apparatus according to claim 9 or claim 10 wherein said axial bore of said cylindrical housing has a threaded section at the distal end of engagement with said reservoir, and said retaining means comprises a locking nut of sufficient diameter for retaining said valve control means, and having a threaded shank for threadedly engaging said threaded section of said axial bore.

12. An apparatus according to claim 9 or claim 10 further including means to bias said valve control means to a closed position comprises a helically wound spring having a plurality of coils and seated longitudinally in said central opening of said valve body with the lowermost coil of said spring positioned adjacent said injector pin, a check valve seated on said spring, and an annular retainer seated on said valve body and above said check valve, said annular retainer having a central aperture concentric with said opening of said valve body, and said check valve biased against said central aperture by said spring to close said central aperture when the can is in a non-filling position.

13. An apparatus according to claim 12 wherein the uppermost coils of said spring being closed.

* * * * *